US005430257A

United States Patent [19]

Lau et al.

[11] Patent Number: 5,430,257

[45] Date of Patent: Jul. 4, 1995

[54] LOW STRESS WAVEGUIDE WINDOW/FEEDTHROUGH ASSEMBLY

[75] Inventors: James C.-K. Lau, Torrance; Kenneth Lui, Fountain View; James A. Hathaway, Redondo Beach; Ronald A. DePace, Mission Viejo, all of Calif.

[73] Assignee: TRW Inc., Redondo Beach, Calif.

[21] Appl. No.: 929,245

[22] Filed: Aug. 12, 1992

[51] Int. Cl.[6] ..... H01B 17/26

[52] U.S. Cl. ..... 174/151; 174/77 R; 174/152 GM

[58] Field of Search ..... 174/77 R, 151, 152 G, 174/152 GM, 152 R, 153 R, 153 G, 154, 155, 156

[56] References Cited

U.S. PATENT DOCUMENTS

| | | | |
|---|---|---|---|
| 4,061,841 | 12/1977 | Sharma et al. | 429/112 |
| 4,176,901 | 12/1979 | Ishimaru | 174/156 M X |
| 4,180,700 | 12/1979 | Kraska et al. | 174/152 GM |
| 4,213,004 | 7/1980 | Acker et al. | 174/151 |
| 4,231,003 | 10/1980 | Ishimaru | 333/33 |
| 4,231,847 | 11/1980 | Lui | 204/7 |
| 4,678,868 | 7/1987 | Kraska et al. | 174/152 GM |
| 4,902,091 | 2/1990 | Althaus et al. | 350/96.2 |
| 4,921,738 | 5/1990 | Cassidy | 174/268 X |
| 5,198,885 | 3/1993 | Ibrahim | 257/70.1 |
| 5,223,672 | 6/1993 | Pinneo et al. | 174/52.4 |
| 5,243,492 | 9/1993 | Marquit et al. | 361/247 |
| 5,305,413 | 4/1994 | Payne | 385/128 |

*Primary Examiner*—Leo P. Picard
*Assistant Examiner*—Christopher Horgan

[57] ABSTRACT

An apparatus for mounting a waveguide window or conduction member into a housing such that a smooth gradient of the coefficient of thermal expansion exists between the housing and the window or conduction member, thereby reducing the internal stress which results from ambient temperature variations. The apparatus comprises a frame member for mounting a feedthrough member into a housing. The frame member includes a buffer section having a plurality of sections, each section having a material which progressively varies the coefficient of thermal expansion. The frame member further includes additional stress relief features and structural elements facilitating manufacture and assembly of the apparatus.

20 Claims, 3 Drawing Sheets

LOW STRESS WAVEGUIDE WINDOW/FEEDTHROUGH ASSEMBLY

BACKGROUND OF THE INVENTION

1. Technical Field

The present invention relates generally to an apparatus for mounting a feedthrough member into a housing and, more particularly, to an apparatus for mounting either a window or a conduction member into a housing which reduces the internal stress in the apparatus resulting from ambient temperature variations.

2. Discussion

Waveguide windows and feedthrough assemblies allow electromagnetic energy to interact between components located in an enclosed circuit network and those located in an external environment. These apparatuses generally include a feedthrough member which transmits or conducts externally propagating energy into the circuit network, a frame member which reinforces the feedthrough member and allows it to be appropriately positioned relative to the circuit network and a housing which encloses the circuit network.

A waveguide window directs electromagnetic energy propagating in the atmosphere into the circuit network through a window that is transparent to the electromagnetic energy. The waveguide window material typically incorporates a low dielectric constant and low loss factor material, such as fused silica. A feedthrough assembly allows an external transmission line in which electromagnetic energy is propagated to be connected to a conduction member to conduct the energy directly into the circuit network. The conduction member generally is constructed of a metal conductor core surrounded by an insulating sleeve.

In addition to their desirable properties, the material of these feedthrough members typically has a low coefficient of thermal expansion (CTE) and low strength. In an effort to prevent failure of the waveguide window or conduction member, a frame member made of material with a low coefficient of thermal expansion but a substantially higher strength is used to mount the feedthrough member into the housing of the circuit network. In an effort to minimize the weight of the housing a lightweight material, such as aluminum, is preferred. These materials typically have a relatively high coefficient of thermal expansion (CTE).

High internal stress levels can be generated during temperature changes as a result of the vast differences in the CTEs of the circuit network components. These high stress levels can deteriorate or destroy the feedthrough member or cause separation of the interface between the feedthrough member and the housing.

The prior art shows structural modifications to the frame member such as grooves, to provide stress relief. These have been of limited effectiveness particularly at the interface of the dissimilar materials. Accordingly, there is a need to provide an improved waveguide window or feedthrough apparatus for reducing the internal stress level and increasing the longevity, reliability and durability of the apparatus.

SUMMARY OF THE INVENTION

The preferred embodiment of the present invention incorporates buffer materials in between the feedthrough member and the housing which have intermediate CTEs, thereby smoothing the CTE gradient from the housing to the feedthrough member. The present invention enables the preferred waveguide window material or conduction member material with its relatively low CTE to be used with the preferred housing material with its relatively high CTE and to be placed in environments which experience large fluctuations in temperature without adversely affecting the longevity, reliability and durability of the feedthrough assembly.

The waveguide window or feedthrough assembly according to this invention includes a housing, a frame member and a feedthrough member, where each structural element has different CTEs. The frame member, having a top face, a bottom face, an outer periphery and an inner wall defining a bore within the outer periphery extending between the top face and the bottom face, is mounted in the housing. The frame member further includes a buffer section for providing progressively different CTEs in the apparatus in a direction from the housing to the feedthrough member and positions and secures the feedthrough member so as to bridge the bore.

From the subsequent detailed description and dependent claims taken in conjunction with the accompanying drawings, other objects and advantages of the present invention will become apparent to those skilled in the art.

BRIEF DESCRIPTION OF THE DRAWINGS

The various advantages of the present invention will become apparent to those skilled in the art after a study of the following specification and by reference to the drawings in which.

DESCRIPTION OF THE PREFERRED EMBODIMENTS

Figure 1:
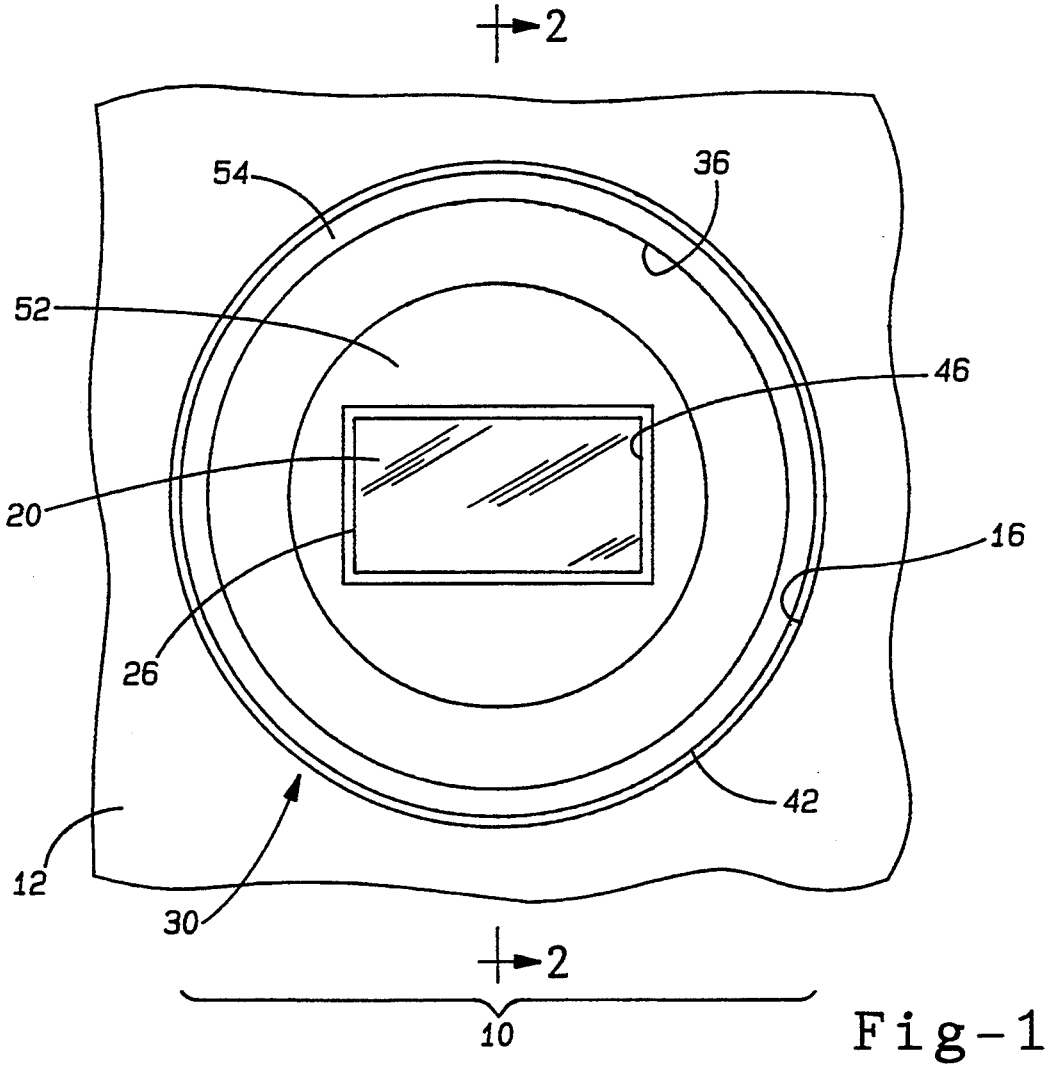
FIG. 1 is a plan view of a low stress waveguide window apparatus in accordance with the present invention.

It should be understood that the following description of the preferred embodiments is merely exemplary in nature and in no way intended to limit the invention or its application or uses. With reference to the Figures, feedthrough assembly 10 includes housing 12 and a frame member 30 for mounting a feedthrough member, such as window 20 or conduction member 60, to housing 12. As an example, electromagnetic microwave energy propagating towards housing 12 is transmitted through window 20 of feedthrough assembly 10 to circuit components, such as sensor 32, within housing 12. Frame member 30 enables window 20 to be efficiently mounted into housing 12. It should be noted that the wave propagation could occur in a reverse sequence from that described above.

Figure 2:
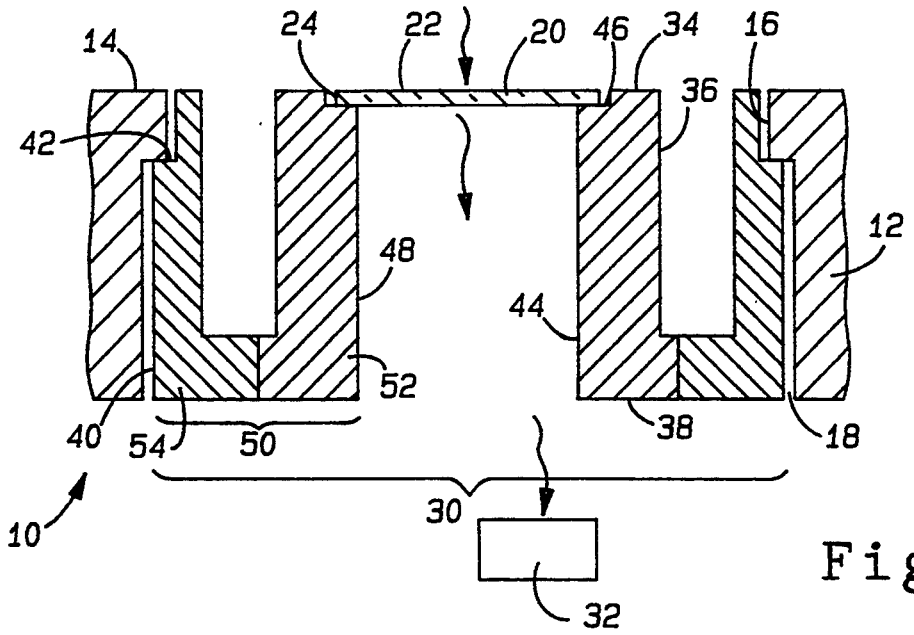
FIG. 2 is a cross-sectional side view taken along the lines 2—2 of FIG. 1.
Figure 3:
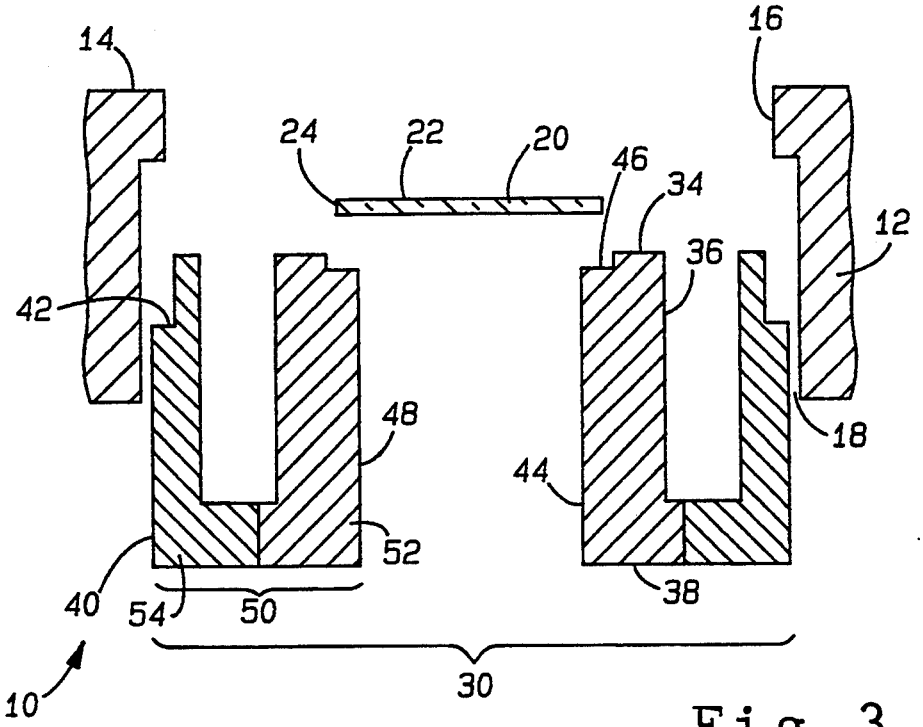
FIG. 3 is a cross-sectional side view similar to FIG. 2 but illustrating the components in an exploded manner.

Turning to FIGS. 2 and 3, a better understanding of the present invention may be acquired. Frame member 30 has a top face 34, bottom face 38, outer periphery 40 and inner wall 44 defining internal bore 48. Frame member 30 incorporates buffer section 50 for providing a transition between the difference in the CTE of housing 12 and the CTE of window 20. Buffer section 50 includes inner section 52 extending from inner wall 44 outwardly towards outer periphery 40 and outer section 54 intimately adjacent to inner section 52 extending outwardly to outer periphery 40.

The material for inner section 52 is selected such that its CTE is approximately equal to or greater than the CTE of window 20. The material for outer section 54 is selected such that its CTE is greater than the CTE of inner section 52 but less than the CTE of housing 12. A smoother CTE gradient from window 20 to housing 12 may be achieved by selecting the materials thusly.

Preferably window 20 is constructed of fused silica having a CTE of approximately 1 micrometers per meter per degree celsius (μm/m/° C.) and housing 12 constructed of aluminum having a CTE of approximately 24 μm/m/° C. Internal bore 48 acts as a waveguide for electromagnetic energy propagating through window 20. In this preferred embodiment an appropriate material selection for inner section 52 is a low-expansion alloy of iron and nickel, preferably Invar, having a CTE of approximately 1 μm/m/° C., and an appropriate material selection for outer section 54 is nickel having a CTE of approximately 13 μm/m/° C.

Figure 4:
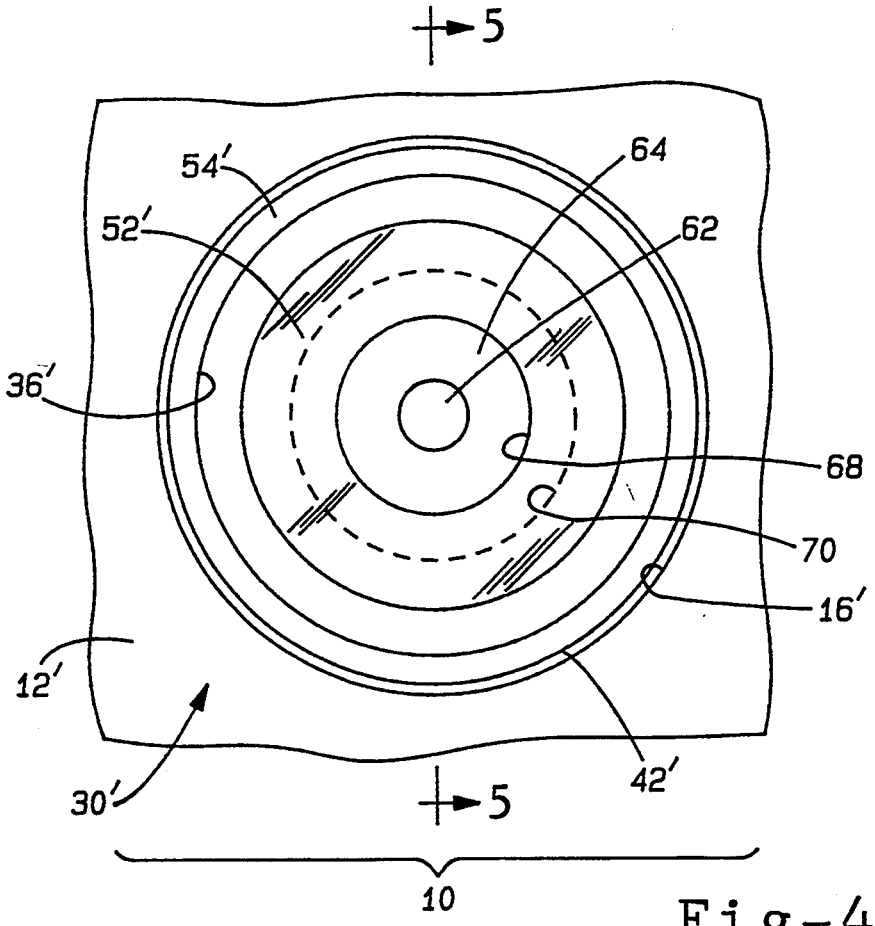
FIG. 4 is a plan view of a low stress feedthrough assembly in accordance with an alternate embodiment of the present invention.
Figure 5:
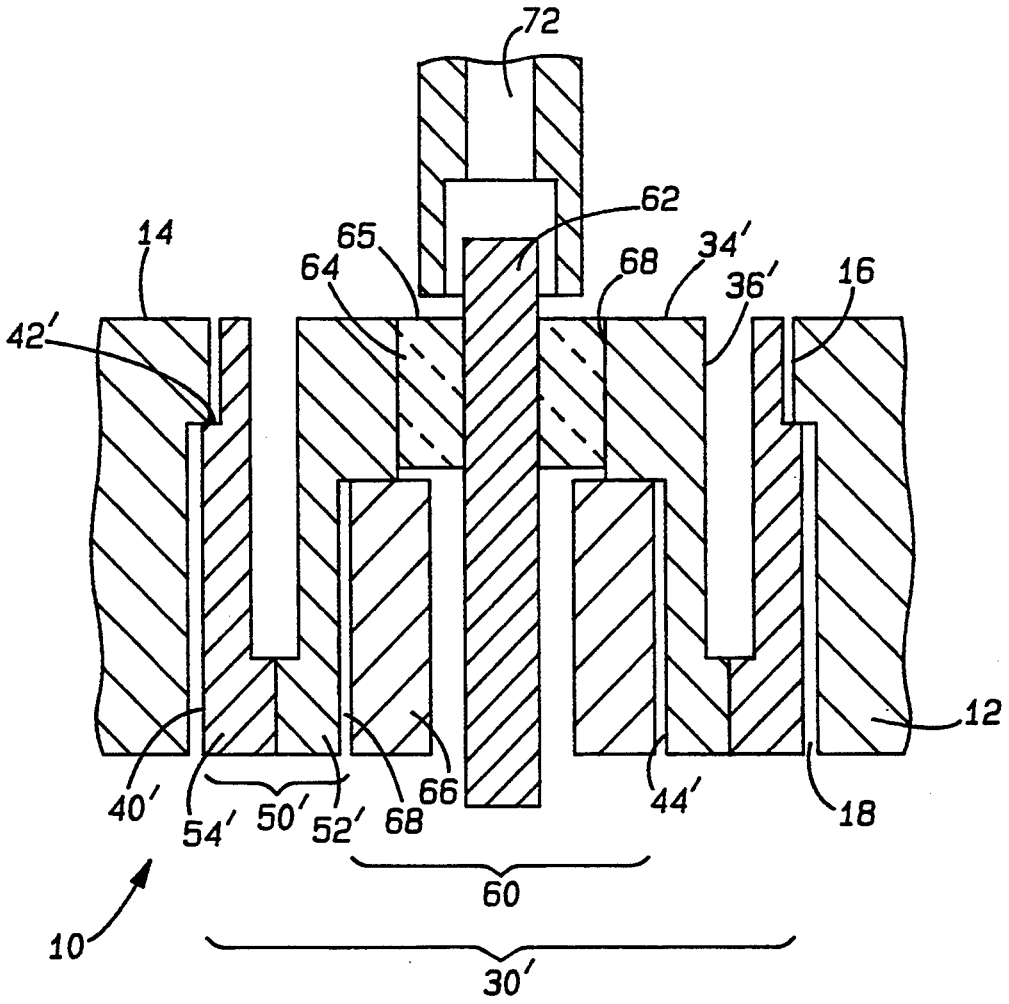
FIG. 5 is a cross-sectional side view taken along the lines 5—5 of FIG. 4.

An alternate embodiment of feedthrough assembly 10 is shown in FIGS. 4 and 5 where the feedthrough member is conduction member 60 instead of window 20. Electromagnetic energy propagates through transmission line 72 which is connected to conductor core 62. Insulation sleeve 64 is concentrically located about the longitudinal axis of conductor core 62 and insulates conductor core 62 from frame member 30'. Conductor core 62 is constructed of a conductive metal, preferably an alloy of iron, nickel and cobalt such as Kovar, having a CTE of approximately 5 μm/m/° C. Insulation sleeve 64 is constructed of an insulation material such as 7052 glass having a CTE approximately equal to that of conductor core 62. In this alternate embodiment an appropriate material selection for inner section 52' is Kovar having a CTE of approximately 5 μm/m/°C. and an appropriate material selection for outer section 54' is nickel having a CTE of approximately 13 μm/m/°C.

In this embodiment, sleeve 64 is affixed to outer bore wall 68, while annular insert 66 is secured to the inner bore wall 70 having a larger diameter than outer bore wall 68. Annular insert 66 is concentrically located about conductor core 62 on the end opposite transmission line 72 and serves to provide impedance matching.

While various methods of manufacture for the multiple-layered buffer section 50 of either embodiment may be used, a suitable and presently preferred method for manufacture is disclosed in U.S. Pat. No. 4,231,847 entitled "Electro-deposition of Nickel-Iron Alloys Having a Low Temperature Coefficient and Articles Made Therefrom" to Lui, which is assigned to the assignee of the present invention and is incorporated by reference herein. In addition, while the presently preferred embodiment discloses a specific two-material buffer section, additional intermediate sections could intervene inner section 52 and outer section 54. Also, an alternate selection of materials with different CTEs could be made to achieve various gradients between the CTE of housing 12 and the CTE of window 20 or conduction member 60.

With reference to both embodiments shown in the Figures, groove 36 is incorporated into frame member 30 as an additional stress relief feature. Groove 36 extends downward from top face 34 separating portions of inner section 52 from outer section 54. The width of groove 36 is such that an interface between inner section 52 and outer section 54 only exists between the bottom of groove 36 and bottom face 38.

In FIGS. 2 and 3 window 20 is mounted on the top face 34 of frame member 30 via rabbet 46 circumscribing internal bore 48. Rabbet 46 is located in inner section 52 such that top face 22 of window 20 is flush with top face 34 of frame member 30 and window 20 bridges internal bore 48. Edge 24 of window 20 is supported by rabbet 46 and the mutually opposing surfaces of rabbet 46 and edge 24 are secured together. While soldering is the presently preferred means for securing window 20 to frame member 30 other suitable means for securing may be employed.

With reference to FIGS. 4 and 5, insulation sleeve 64 is appropriately positioned onto frame member 30' such that top face 34' of frame member 30' is flush with top face 65 of insulation sleeve 64 and secured together. While firing is the presently preferred means for securing insulation sleeve 64 to frame member 30' other suitable means for securing may be employed.

With reference to both embodiments shown in the Figures shoulder 42 is formed in the upper portion of outer periphery 40 for mounting frame member 30 into housing 12. Lip 16 is formed at top face 14 of housing 12 such that lip 16 is supported by shoulder 42 and mutually opposing surfaces of lip 16 and shoulder 42 are secured together. Gap 18 is maintained between the lower portion of housing 12 and the lower portion of outer periphery 40 when frame member 30 is mounted into housing 12. Frame member 30 is mounted into housing 12 such that top face 22 of window 20 and top face 34 of frame member 30 are flush with top face 14 of housing 12. While soldering is the presently preferred means for securing frame member 30 to housing 12, other suitable means for securing may be employed.

From the foregoing, those skilled in the art should realize that the present invention enables the preferred waveguide window material or conduction member material to be incorporated with the preferred housing material and placed in environments which experience large fluctuation in temperature without adversely affecting the longevity, reliability and durability of the apparatus.

Although the invention has been described with particular reference to a preferred embodiment and an alternate embodiment, variations and modifications can be effected within the spirit and scope of the following claims.

I claim:

1. A feedthrough assembly for mounting a feedthrough member into a housing, the housing having a given coefficient of thermal expansion (CTE) with the feedthrough member having a different coefficient of thermal expansion (CTE), said feedthrough assembly comprising:

a frame member having a top face, a bottom face, an outer periphery and an inner wall defining an internal bore extending between the top face and the bottom face;

said feedthrough member being mounted to the frame member so as to bridge the internal bore;

buffer section, located between the inner wall and the outer periphery, for providing a transition between the differences of CTEs between the feedthrough member and the housing, said buffer section having a plurality of sections of progressively different coefficients of thermal expansion (CTE).

2. The feedthrough assembly of claim 1 wherein said buffer section further comprises:

an inner section having a CTE approximately equal to or greater than the CTE of the feedthrough member and less than the CTE of the housing; and an outer section having a CTE greater than the CTE of the inner section and less than the CTE of the housing.

3. The feedthrough assembly of claim 2 wherein said feedthrough member is a window mounted to the frame member so as to bridge the internal bore.

4. The feedthrough assembly of claim 3 wherein:

said window has a CTE of 0.4 to 2 micrometers per meter per degree Celsius;

said inner section has a CTE of 0.4 to 2 micrometers per meter per degree Celsius;

said outer section has a CTE of 9 to 16 micrometers per meter per degree Celsius; and said housing has a CTE greater than 16 micrometers per meter per degree Celsius.

5. The feedthrough assembly of claim 4 wherein the window is made of fused silica, the inner section is made of Invar, the outer section is made of nickel and the housing is made of aluminum.

6. The feedthrough assembly of claim 2 wherein said feedthrough member is a conduction member mounted to the frame member so as to bridge the internal bore, said conduction member comprising:

a conductor core extending along the longitudinal axis of the internal bore; and an insulation sleeve located in an outer portion of the internal bore.

7. The feedthrough assembly of claim 6 wherein said internal bore further comprises:

outer bore portion extending from the upper face of the frame member having a first diameter for positioning said conduction member; and inner bore portion extending from said outer bore portion to the bottom face of the frame member having a second diameter for accommodating an annular insert concentrically about the conductor core extending through the internal bore.

8. The feedthrough assembly of claim 6 wherein:

said conductor core has a CTE of 4 to 6 micrometers per meter per degree Celsius;

said insulation sleeve has a CTE of 4 to 6 micrometers per meter per degree Celsius;

said inner section has a CTE of 4 to 6 micrometers per meter per degree Celsius;

said outer section has a CTE of 9 to 16 micrometers per meter per degree Celsius; and said housing has a CTE greater than 16 micrometers per meter per degree Celsius.

9. The feedthrough assembly of claim 8 wherein the conductor core is made of Kovar, the insulation sleeve is made of 7052 glass, the inner section is made of Kovar, the outer section is made of nickel and the housing is made of aluminum.

10. The feedthrough assembly of claim 2 wherein said frame member has a groove in the top face separating portions of the inner section from the outer section.

11. The feedthrough assembly of claim 1 wherein said feedthrough assembly further comprises:

said inner wall having a rabbet in the top face circumscribing said internal bore;

edges of the feedthrough member being supported by said rabbet; and mutually opposing surfaces of the rabbet and the edges of the feedthrough member being secured together.

12. The feedthrough assembly of claim 11 wherein a top face of the feedthrough member is mounted flush with the top face of the frame member.

13. The feedthrough assembly of claim 1 wherein an upper portion of the outer periphery is connected to an upper portion of the housing, with a space being maintained between the lower portions of the housing and the outer periphery of the frame member.

14. The feedthrough assembly of claim 1 wherein said feedthrough assembly further comprises:

said upper portion of the housing has a lip;

said outer periphery has a shoulder formed therein which engages the lip; and mutually opposing surfaces of the shoulder and the lip being secured together.

15. The feedthrough assembly of claim 14 wherein a top face of the frame member is mounted flush with a top face of the housing.

16. The feedthrough assembly of claim 1 wherein top faces of the housing, frame member and feedthrough member are flush.

17. The feedthrough assembly of claim 1 wherein said frame member is annular.

18. The feedthrough assembly of claim 1 wherein said feedthrough assembly further comprises sensor means located within the housing and in axial alignment with the internal bore for receiving electromagnetic energy transmitted through the feedthrough member.

19. A feedthrough assembly for mounting a window into a housing, the housing having a given coefficient of thermal expansion (CTE) and the window having a different coefficient of thermal expansion (CTE), said feedthrough assembly comprising:

(a) an annular frame member having a top face, a bottom face, an outer periphery and an inner wall defining an internal bore extending between the top face and the bottom face;

(b) edges of the window being supported by said annular frame member and mutually opposing surfaces of said annular frame member and said window being secured together such that the window bridges the bore;

(c) buffer section, located between the inner wall and the outer periphery, for providing a transition between the differences of the CTEs of the window and the housing wherein said buffer section further includes, (1) an inner section having a CTE approximately equal to the CTE of the window;

(2) an outer section having a CTE, greater than the CTE of the inner section and less than the CTE of the housing;

(d) wherein said annular frame member further includes, (1) a groove in the top face separating portions of the inner section from the outer section; and (2) an upper portion of said outer periphery engaging an upper portion of the housing such that a space is maintained between lower portions of the housing and the outer periphery and mutually opposing surfaces of the upper portions of the housing and the outer periphery being secured together.

20. A feedthrough assembly for mounting a conduction member into a housing, the housing having a given coefficient of thermal expansion (CTE) and the conduction member having a conductor core and an insulation sleeve concentrically located about the longitudinal axis of said conductor core, each of said conduction member elements having approximately equal coefficients of thermal expansion (CTE) which are different from the CTE of said housing, said feedthrough assembly comprising:

(a) an annular frame member having a top face, a bottom face, an outer periphery and an inner wall defining an internal bore extending between the top face and the bottom face, said internal bore further includes, (1) an outer bore wall extending from the top face having a first diameter for appropriately positioning and securing said conduction member to bridge the internal bore; and (2) an inner bore wall extending from said outer bore wall to the bottom face having a second diameter for locating an annular insert concentrically about the conductor core;

(b) buffer section, located between the inner wall and the outer periphery, for providing a transition between the differences of the CTEs of the conduction member and the housing wherein said buffer section further includes, (1) an inner section having a CTE approximately equal to the CTE of the conduction member;

(2) an outer section having a CTE greater than the CTE of the inner section and less than the CTE of the housing;

(c) wherein said annular frame member further includes, (1) a groove in the top face separating portions of the inner section from the outer section; and (2) an upper portion of said outer periphery engaging an upper portion of the housing such that a space is maintained between lower portions of the housing and the outer periphery and mutually opposing surfaces of the upper portions of the housing and the outer periphery being secured together.

* * * * *